US010425755B2

(12) United States Patent
Nishikori et al.

(10) Patent No.: US 10,425,755 B2
(45) Date of Patent: Sep. 24, 2019

(54) AUDIO SIGNAL PROCESSING DEVICE

(71) Applicant: Yamaha Corporation, Hamamatsu-shi, Shizuoka-ken (JP)

(72) Inventors: Taku Nishikori, Hamamatsu (JP); Takumi Tanaka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 37 days.

(21) Appl. No.: 14/943,975

(22) Filed: Nov. 17, 2015

(65) Prior Publication Data

US 2016/0142842 A1 May 19, 2016

(30) Foreign Application Priority Data

Nov. 17, 2014 (JP) ..... 2014-233019

(51) Int. Cl.
*H04R 29/00* (2006.01)
*H04H 60/04* (2008.01)

(52) U.S. Cl.
CPC ..... *H04R 29/008* (2013.01); *H04H 60/04* (2013.01); *H04R 29/007* (2013.01)

(58) Field of Classification Search
CPC ..... H04R 29/008; H04R 29/007; H04H 60/04
See application file for complete search history.

(56) References Cited

U.S. PATENT DOCUMENTS

| | | | | |
|---|---|---|---|---|
| 8,214,065 | B2 | 7/2012 | Aoki et al. | |
| 2005/0190933 | A1 | 9/2005 | Hamada et al. | |
| 2006/0015198 | A1 | 1/2006 | Okabayashi et al. | |
| 2013/0230194 | A1 * | 9/2013 | Terada | H04H 60/04 381/119 |

FOREIGN PATENT DOCUMENTS

| | | |
|---|---|---|
| EP | 1 571 768 A2 | 9/2005 |
| EP | 1 571 768 A3 | 9/2005 |

OTHER PUBLICATIONS

Extended European Search Report dated Apr. 18, 2016, for EP Patent Application No. 15194755.3, ten pages.
Yamaha. (Date Unknown). "PM5D Digital Mixing Console," PM5D/PM5D-RH V2, DSP5D, Owner's Manual, two pages.
Chinese Office Action dated Nov. 23, 2018, for CN Application No. 201510790231.1, with English translation, 17 pages.

* cited by examiner

*Primary Examiner* — Ping Lee
(74) *Attorney, Agent, or Firm* — Morrison & Foerster LLP

(57) ABSTRACT

An audio signal processing device, including: input ports; channels; a first input patch to patch one of the input ports to one of the channels; a second input patch to patch one of the input ports to one of the input channels, wherein whether switching is enabled or disabled is set for each channel; and a mode selector to select a first mode or a second mode, wherein, in the first mode, the one input channel receives audio signals of the one input port patched in the first input patch, and wherein, in the second mode, the one channel set to be enabled receives audio signals of the one input port patched in the second input patch while the one channel set to be disabled receives audio signals of the one input port patched in the first input patch.

12 Claims, 7 Drawing Sheets

RECORDER PATCH SETTING SCREEN

INPUT PATCH SETTING SCREEN

RECORDER PATCH SETTING SCREEN

AUDIO SIGNAL PROCESSING DEVICE

CROSS REFERENCE TO RELATED APPLICATION

The present application claims priority from Japanese Patent Application No. 2014-233019, which was filed on Nov. 17, 2014, the disclosure of which is herein incorporated by reference in its entirety.

BACKGROUND OF THE INVENTION

Field of the Invention

The present invention relates to an audio signal processing device in which audio signals input from a plurality of input ports are processed in a plurality of input channels. More particularly, the invention relates to such an audio signal processing device suitable for conducting virtual soundcheck, i.e., "VIRTUAL SOUNDCHECK" (registered trademark), utilizing recording in real performance.

Description of Related Art

There have been known public addressing (PA) that is broadcast equipment for transmitting audio information to many people in facilities, schools, etc., and sound reinforcement (SR) that is broadcast equipment for transmitting performance sounds and vocal sounds with uniform sound quality to every corner of even large-scale halls such as concert halls. At sites of PA/SR, performance sounds of musical instruments and vocal sounds are picked up by microphones, and a mixer is used to mix the picked-up sounds and to send the mixed sounds to power amplifiers, various recording devices, effecters, and performing players. Conventional mixers include: an I/O unit having (a) input ports to which are input audio signals picked up by microphones and audio signals sent from synthesizers or the like and (b) output ports for outputting digital and analog audio signals; an audio signal processing unit for executing mixing processing and effect processing on digital audio signals; and a console on which are provided various panel controls for controlling, according to user's operations, the audio signal processing unit and the I/O unit. In the thus constructed mixers, the audio signals input from the input ports are characteristic-adjusted in input channels patched to the respective input ports, and are subjected to processing such as mixing. The processed audio signals are output to an amplifier connected to the output ports, and a plurality of speakers installed in a hall, a venue or the like are driven by the audio signals that are power-amplified by the amplifier.

At the conventional PA/SR sites, audio signals input to the input channels of the mixer at the time of real performance in a certain hall are output to and recorded in a recorder without conducting characteristic adjustment. When audio adjustment is conducted in the same hall or another hall, the audio signals recorded in the recorder are input to the input channels as an input simulating real performance so as to permit the mixer to execute signal processing as in real performance, and setting of various units of the mixer is adjusted while monitoring sounds output from speakers in the hall. By thus adjusting setting, the audio adjustment in the hall can be conducted even if performers are not present on the spot. The applicant of the present application refers to the adjustment work itself and relating mixer functions as "virtual soundcheck".

In digital mixers described in the following Non Patent Literature 1 and Patent Literature 1, input ports for real performance can be switched, in advance, to input ports for virtual soundcheck, on a switching setting screen for input ports. In audio adjustment in a hall, when a "virtual soundcheck" button is turned on by a user, the input ports for real performance are switched to the input ports for virtual soundcheck in an input patch according to the switching setting. To the input channels, playback sounds from the recorder recorded in real performance are supplied from the switched input ports, according to the input patch, and characteristic adjustment of the audio signals can be conducted in the input channels. In real performance after the characteristic adjustment, the "virtual soundcheck" button is turned off, so that the switching setting in the input patch returns to original. As a result, audio signals from a stage are supplied from the input ports for real performance to the input channels and are subjected to signal processing in the input channels in which characteristic adjustment has been finished.

The recorder is a multitrack recorder (MTR) that enables simultaneous recording and reproduction in a plurality of tracks. In recent years, a computer configured to operate as a digital audio workstation (DAW) system by execution of "DAW software" is often used as MTR. In the DAW system, it is possible to conduct, in addition to multitrack recording, various processing of the audio signals such as waveform editing, addition of sound effects, and mixdown.

Non Patent Literature 1: "PM5D/PM5D-RH V2 DSP5D Owner's Manual", YAMAHA CORPORATION, p. 221

Patent Literature 1: U.S. Pat. No. 8,214,065

SUMMARY OF THE INVENTION

In the conventional digital mixers described above, virtual soundcheck setting is made on the switching setting screen such that replacement input ports to be used are allocated to the respective input ports to be switched. It is impossible to directly and visually confirm, in virtual soundcheck, the audio signals of which input ports are supplied to which input channels.

In an instance where it is desired to use input ports for real performance in some of the input channels in accordance with a performer who is present on the spot in virtual soundcheck, it is needed to switch the input ports corresponding to some of the input channels to the ones for real performance, on the switching setting screen. It is not easy to change virtual soundcheck setting depending on the performer who is present on the spot.

Further, on the conventional switching setting screen, switching setting is made for all of the input ports. Thus, switching setting needs to be made for input ports that are irrelevant to virtual soundcheck. Hence, there is a demand for simplification of setting by limiting input ports for which setting is made to only input ports relevant to virtual soundcheck.

Conventionally, when "virtual soundcheck" is on, setting of the input patch per se changes. In an instance where input ports, each as connection destination, are being displayed in relation to the input channels, names of the displayed input ports change in accordance with on and off of "virtual soundcheck". For permitting the names of the input ports to remain unchanged, it is needed to set the same port name for two input ports that switch each other.

The conventional virtual soundcheck function is for temporarily changing the setting of the input patch, and it is therefore necessary to additionally make setting for recording in external DAW. In this case, when a transmission channel (output port), through which audio signals of one input channel are transmitted to the DAW, is changed, a transmission channel, through which the audio signals are returned from the DAW when reproduced, is accordingly changed. It is consequently required to accordingly change switching setting of the input port.

Thus, the conventional audio signal processing devices suffer from various problems that make it difficult for the user to easily make virtual soundcheck setting.

It is therefore an object of the invention to provide an audio signal processing device that is free from the problems described above.

The object indicated above may be attained according to a principle of the invention which provides an audio signal processing device, comprising: a plurality of input ports configured to receive audio signals; a plurality of channels configured to process audio signals; a first input patch configured to patch one of the input ports to one of the channels; a second input patch configured to patch one of the input ports to one of the channels and configured to set, for each of the channels, whether switching is enabled or disabled; and, a mode selector configured to select one of a first mode and a second mode, wherein, when the first mode is selected, the one of the channels receives audio signals of the one of the input ports patched in the first input patch, and wherein, when the second mode is selected, the one of the channels for which the switching is set to be enabled receives audio signals of the one of the input ports patched in the second input patch while the one of the channels for which the switching is set to be disabled receives audio signals of the one of the input ports patched in the first input patch.

According to the audio signal processing device constructed as described above, it is possible to easily make various sorts of setting for virtual soundcheck such as setting for connecting one input channel to one input port such that audio signals of one track are supplied to the input channel in audio adjustment in a certain hall and setting for recording the audio signals of the one input channel in the same one track in real performance.

BRIEF DESCRIPTION OF DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
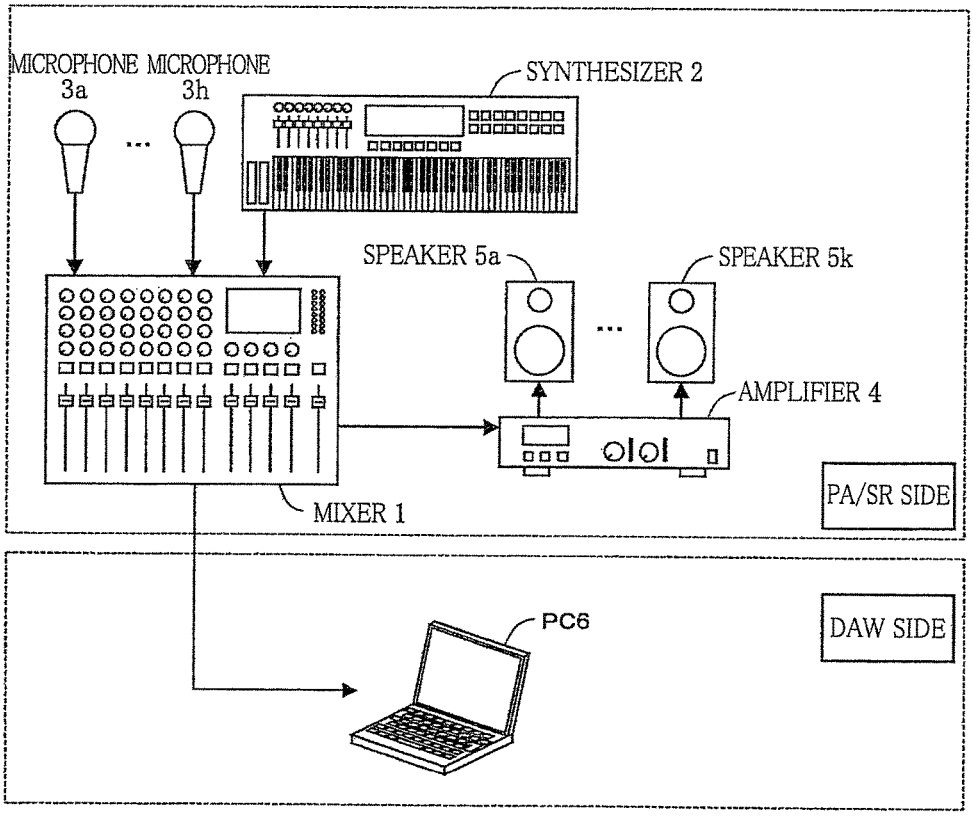
FIG. 1 is a view showing a configuration of an audio signal processing system equipped with a mixer as one embodiment of an audio signal processing device according to the invention.

FIG. 1 is a view showing a configuration of an audio signal processing system equipped with a mixer 1 as one embodiment of an audio signal processing device according to the present invention.

The audio signal processing system shown in FIG. 1 includes a PA/SR system and a digital audio workstation (DAW) system connected to the PA/SR system. The PA/SR system includes the mixer 1 as one embodiment of the audio signal processing device according to the present invention. There are input, to the mixer 1, audio signals from a plurality of microphones 3*a*, . . . , 3*h* installed in a hall or the like and audio signals from a synthesizer 2 or the like. The mixer 1 mixes the input audio signals. The mixed audio signals output from the mixer 1 are supplied to an amplifier 4 and are power-amplified by the same 4. A plurality of speakers 5*a*, . . . , 5*k* installed in the hall emit sounds based on the amplified audio signals.

The DAW system includes a personal computer (PC) 6 on which DAW software is installed. When the DAW software is started in the PC 6, the PC 6 operates as the DAW system. The DAW system functions as a music processing apparatus and is capable of executing music processing such as performance of music tunes, multitrack recording, editing, mixing, etc., of supplied audio signals.

Figure 2:
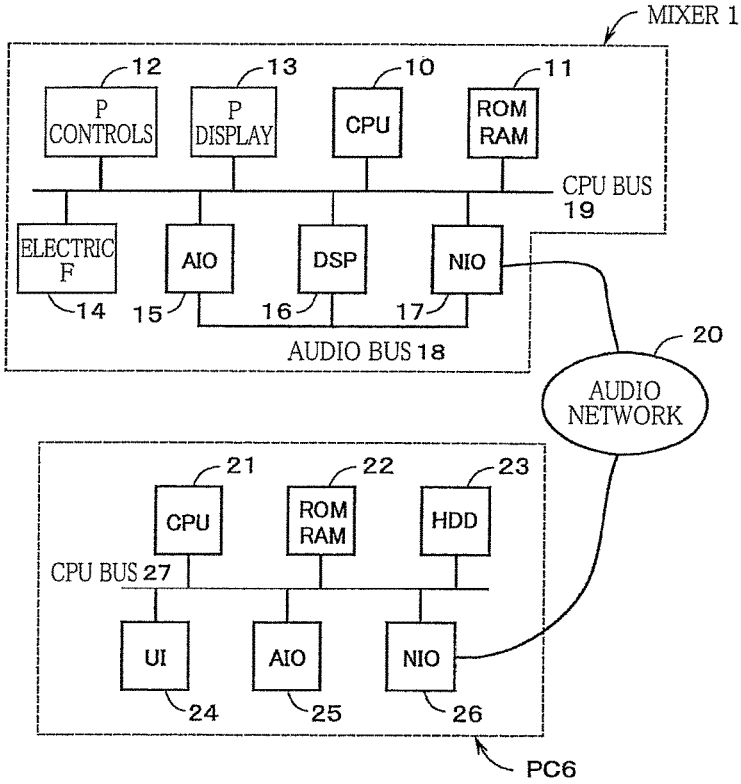
FIG. 2 is a functional block diagram showing a configuration of the audio signal processing system equipped with the mixer according to the embodiment of the invention.

FIG. 2 is a functional block diagram showing a configuration of the audio signal processing system equipped with the mixer 1 according to the embodiment of the audio signal processing device of the invention.

As shown in FIG. 2, the mixer 1 includes a central processing unit (CPU) 10, ROM-RAM (memory) 11, panel (P) controls 12, a panel (P) display 13, electric faders (F) 14, an audio interface (AIO) 15, a digital signal processor (DSP) 16, and a network interface (NIO) 17. These are connected via a CPU bus 19. The AIO 15, the DSP 16, and the NIO 17 are connected via an audio bus 18. The mixer 1 has a function of executing various sorts of signal processing on audio signals input from a plurality of input channels and outputting the processed audio signals from a plurality of output channels.

The CPU 10 is a controller for controlling operations of the mixer 1 in a centralized manner. The CPU 10 executes operation software stored in read only memory (ROM) of the ROM-RAM 11, so as to control display processing in the P display 13, input/output processing in the AIO 15 and the NIO 17, signal processing in the DSP 16, processing in which operations of the P controls 12 are detected so as to set and change parameter values and so as to control operations of portions of the mixer 1, according to the detected operations, and so on.

There is provided, in random access memory (RAM) of the ROM-RAM 11, a work memory area for temporarily storing data. The RAM is memory to be utilized as work memory of the CPU 10. The ROM and the RAM of the ROM-RAM 11 may be configured as mutually independent memory or may be configured such that a part functions as a ROM area while the rest functions as a RAM area, using a flash memory or the like. The ROM-RAM 11 may be configured otherwise.

The P controls 12 are for receiving user's operations to the mixer 1 and are constituted by various keys, buttons, dials, sliders, a mouse, a wheel, a trackball, a touch panel, etc. For instance, one control for controlling one channel may be constituted by a channel strip including a rotation knob, a button, a fader, and the like, and a plurality of channel strips may be provided for the respective channels.

The P display 13 is a display device for displaying various sorts of information according to the control by the CPU 10 and is constituted by a liquid crystal panel (LCD) or the like. In general, reference to parameter values and reception of setting are made through a graphical user interface (GUI). In view of this, the P display 13 has a size that enables a GUI screen to be displayed thereon. On the P display 13, an input patch setting screen and a recorder patch setting screen (which will be explained) are displayed.

The electric F 14 are faders for adjusting an output level of signals sent to buses for mixing and an output level of signals output from the buses. The faders are operated manually or electrically by the user for adjustment.

The audio interface (AIO) 15 includes analog input/output ports and digital input/output ports. The AIO 15 receives, by the input ports, external analog or digital audio signals of a plurality of channels, and supplies digital audio signals of the corresponding channels to the DSP 16 via the audio bus 18. Further, the AIO 15 receives, via the audio bus 18, digital audio signals of the plurality of channels that have been subjected to signal processing by the DSP 16. The received digital signals are output directly or output after having been converted into analog signals, to the external from the output ports. To the analog input ports of the AIO 15, microphones and monaural line level devices are mainly connected. To the analog output ports of the AIO 15, amplifiers are connected which are configured to amplify mixed audio signals sent from the mixer 1 and to supply the amplified audio signals to speakers. In the present embodiment, the input/output ports are constituted substantially by an I/O card mounted on an expansion slot. The mixer 1 has six expansion slots, i.e., SLOT1-SLOT6. Microphones, line level devices, amplifiers, and the like are connected to input/output ports of each of the I/O cards mounted on SLOT1-SLOT6.

The NIO 17 is an interface of an audio network and includes an expansion slot SLOT8 on which is mounted a network adaptor having output ports for transmitting audio signals and input ports for receiving audio signals. The NIO 17 receives, by the input ports of the network adaptor, digital audio signals of a plurality of channels from other device (e.g., the PC 6) via an audio network 20 to which the NIO 17 is connected, and supplies the received audio signals of the plurality of channels to the DSP 16 via the audio bus 18. Further, the NIO 17 receives, via the audio bus 18, digital audio signals of the plurality of channels that have been subjected to signal processing by the DSP 16. The received digital signals are transmitted by the output ports of the network adaptor to other device (e.g., the PC 6) via the audio network 20.

The DSP 16 is a signal processor constituted by one or a plurality of DSPs (semiconductor chips). By execution of a microprogram set by the CPU 10, the DSP 16 executes, with respect to audio signals supplied from the AIO 15 and the NIO 17, various sorts of signal processing such as equalizing and mixing according to various control data values set by the CPU 10 and supplies, to the AIO 15 and the NIO 17, the audio signals that have been subject to the signal processing.

The PC 6 shown in FIG. 2 is a general-purpose computer. The PC 6 includes: a CPU 21 that executes an operating system (OS) such as Windows (trademark); and ROM-RAM 22 (memory) including nonvolatile ROM in which is stored software such as a basic input/output system (BIOS) executed upon power-up of the PC 6 and RAM which is used as work memory of the CPU 21 and which stores various sorts of data or the like. An HDD 23 is a rewritable bulk storage (hard disc device) in which application software such as management software and DAW software executed by the CPU 21 is stored. The CPU 21 executes the DAW software, whereby the PC 6 operates as the DAW system having a multitrack recorder function (MTR function) having at least 36 tracks. A user interface (UI) 24 is controls such as a keyboard and a mouse and a display device such as a liquid crystal panel (LCD). An AIO 25 functions as an input portion of the DAW system so as to receive external analog or digital audio signals of a plurality of channels and functions as an output portion of the DAW system so as to output, to the exterior, processed digital audio signals of the plurality of channels. In this case, the digital audio signals are output directly or output after having been converted into analog signals. An NIO 26 is an interface of an audio network. The NIO 26 functions as a reception portion of the DAW system so as to receive digital audio signals of a plurality of channels from other device (e.g., the mixer 1) via the audio network 20 to which the NIO 26 is connected. Further, the NIO 26 functions as a transmission portion of the DAW system so as to transmit processed audio signals of the plurality of channels to other device (e.g., the mixer 1) via the audio network. By utilizing the MTR function as one of the functions of the DAW, the audio signals of the plurality of channels input from the other device can be recorded, and the audio signals of the plurality of channels reproduced by the DAW can be output to the other device.

In the present embodiment, the NIO 17 of the mixer 1 and the NIO 26 of the PC 6 are connected by the audio network 20. In this DAW system, audio signals of a plurality of channels transmitted from a plurality of output ports of the NIO 17 of the mixer 1 can be received by the NIO 26 via the audio network 20, and the received audio signals of the plurality of channels can be recorded in a plurality of tracks. Further, audio signals of the plurality of channels reproduced in the plurality of tracks of the DAW system can be transmitted by the NIO 26 to the mixer 1 via the audio network 20, and the mixer 1 can receive the audio signals of the plurality of channels by the input ports of the NIO 17 and execute signal processing on the received audio signals of the respective channels. Each of the output ports and each of the input ports of the NIO 17 are identified by an output port number and an input port number. For the sake of simplifying the explanation, the mixer 1 and the PC 6 are set as follows. That is, in an instance where audio signals that have been transmitted to the DAW system from one output port of the NIO 17 of the mixer 1 having a number n and that have been recorded in the DAW system are reproduced in the DAW system and are transmitted to the mixer 1, the audio signals are received by the input port of the NIO 17 of the mixer 1 having the same number n.

Using the audio signal processing system described above, the following work can be conducted: preparation work for virtual soundcheck in which audio signals supplied to the input channels of the mixer 1 in real performance are output from the mixer 1 without conducting characteristic adjustment and are recorded in the DAW of the PC 6; and virtual soundcheck work (hereinafter referred to as "VSC" where appropriate) in which, when audio adjustment in a hall or a venue is conducted, the audio signals that have been recorded in the DAW are reproduced, signal processing as in real performance is executed by the mixer 1 utilizing the reproduced audio signals as an input that simulates real performance, and setting adjustment of the signal processor in the mixer 1 is conducted while monitoring the sounds from the speakers as the result of the signal processing in the mixer 1. In VSC, it is possible to adjust hearing conditions of music instrument sounds and vocal sounds in the hall just like in real performance, utilizing musical instrument sounds such as a drum, a bass, a guitar, a piano and vocal sounds that have been separately recorded in real performance.

Figure 3:
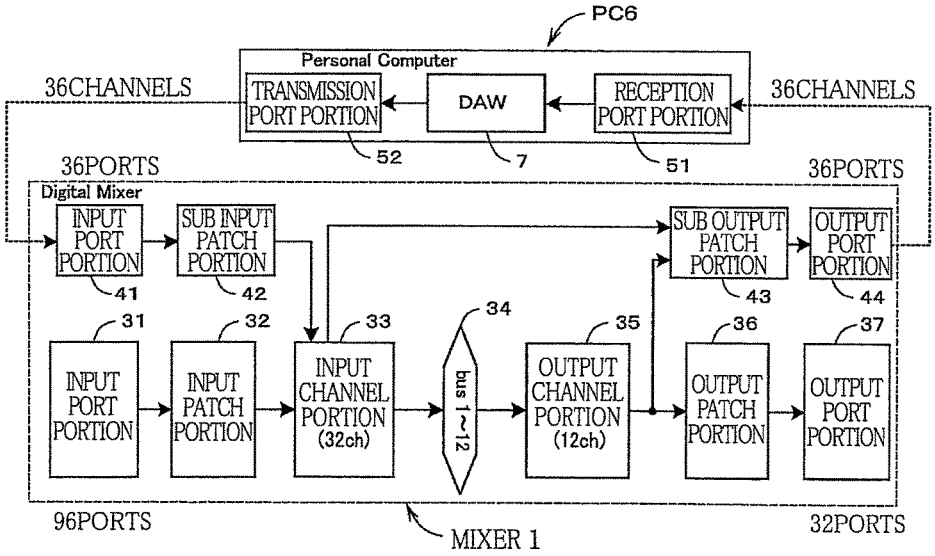
FIG. 3 is a block diagram showing a configuration of signal processing in the mixer according to the embodiment of the invention and a digital audio workstation (DAW) system.

The present mixer 1 operates in one of the following two modes selected by the user, i.e., "normal mode" (as one example of a first mode) when the VSC function is off and "check mode" (as one example of a second mode) when the VSC function is on. FIG. 3 shows a configuration of signal processing in the mixer 1 and the PC 6 as the DAW.

As shown in FIG. 3, the mixer 1 includes: an input port portion 31 that include a first group of input ports for a normal operation (usual PA/SR); an input patch portion 32 (as one example of a first input patch); an input port portion 41 that include a second group of input ports for VSC; and a sub input patch portion 42 (as one example of a second input patch) that is an input patch for VSC. In the present embodiment, the first group of input ports includes 96 ports of SLOT1-SLOT6 each having 16 ports while the second group of input ports includes 36 ports of SLOT8. The input patch portion 32 is provided between the input port portion 31 and an input channel portion 33 having 32 channels, for instance. In the input path portion 32, one of the input ports of the input port portion 31 is patched or assigned (connected) to one of the input channels according to user's instructions. The sub input patch portion 42 is disposed between the input port portion 41 and the input channel portion 33. In the sub input patch portion 42, one of the input ports of the input port portion 41 is patched or assigned (connected) to one of the input channels according to user's instructions. When the normal mode is selected, there are supplied, to one input channel of the input channels (32 channels), audio signals of one input port of the input port portion 31 patched in the input patch portion 32. When the check mode is selected, it is possible to set enabling or disabling of switching for each input channel. To one input channel of the input channels (e.g., 32 channels) that is set to be "enabled", audio signals of one input port of the input port portion 41 patched in the sub input patch portion 42 are supplied. To one input channel that is set to be "disabled", audio signals of one input port of the input port portion 31 patched in the input patch portion 32 are supplied. In other words, in an instance where the one input port of the input port portion 31 (as one example of a first input port) and one input channel (as one example of a first channel) are patched to each other in the input patch portion 32 while the one input port of the input port portion 41 (as one example of a second input port) and the one input channel are patched to each other in the sub input patch portion 42, it is settable in the sub input patch portion 42 whether switching of the input port patched to the one input channel from the one input port of the input port portion 31 to the one input port of the input port portion 41 is enabled or disabled.

In the input channel portion 33, audio characteristics or the like of the audio signals input from the patched input port are adjusted in the corresponding one of 32 input channels. That is, frequency characteristics and a level of the audio signals input to each input channel are adjusted by an equalizer and a dynamics for each input channel, and the adjusted audio signals are sent to one or a plurality of 12 busses of the bus 34. In the bus 34, the audio signals of one or a plurality of input channels selectively input from given input channels are mixed in each bus, and the mixed output is output from each bus. In the output channel portion 35, there are provided 12 output channels corresponding to the twelve busses of the bus 34, for instance. The mixed audio signals output from each bus are supplied to the corresponding output channel of the output channel portion 35. In each output channel, the characteristics of the audio signals such as frequency balance are adjusted by an equalizer and a compressor, and the characteristic-adjusted audio signals are output to an output patch portion 36.

The present mixer 1 includes the output patch portion 36 and a sub output patch portion 43 that is an output patch for preparation of VSP. The output patch portion 36 is provided between the output channel portion 35 having 12 channels, for instance and an output port portion 37 having 32 ports, for instance. In the output patch portion 36, one of the output channels is patched or assigned (connected) to one of the output ports according to user's instructions. The sub output patch portion 43 is provided between the output channel portion 35 or the input channel portion 33 and an output port portion 44. In the sub output patch portion 43, one of the output channels or a direct-out signal directly input from one of the input channels is patched or assigned (connected) to one of output ports according to user's instructions. In the present embodiment, the output port portion 44 includes 36 output ports of SLOT8.

For instance, each of the 32 output ports of the output port portion 37 is supplied with the audio signals from a corresponding one of the output channels to which the output port is patched in the output patch portion 36. In the output port, digital output channel signals are converted into analog signals, and the analog signals are amplified by an amplifier connected to the output port and are supplied to a plurality of speakers disposed in a hall or the like, so that sounds are emitted from the speakers. Further, the analog signals from the output port may be supplied to an in-ear monitor worn in the ear of a performer on a stage such as a musician or may be supplied to a stage monitor speaker placed in the vicinity of the performer, so as to reproduce sounds.

For instance, each of the 36 output ports of the output port portion 44 is supplied with the audio signals from a corresponding one of the output channels or a corresponding one of the input channels to which the output port is patched in the sub output patch portion 43. The digital audio signals for the 36 channels from the output port portion 44 are received by the reception port portion 51 of the PC 6 via the audio network 20. The audio signals received by the reception port portion 51 are supplied to the DAW 7 that is operating in the PC 6. The DAW 7 is a digital audio workstation (DAW) established by execution of the DAW software in the PC 6. By utilizing the recording/reproducing function of the DAW 7, the audio signals output from the output ports of the output port portion 44 of the mixer 1 are multitrack-recorded in corresponding tracks connected to the respective reception ports of the reception port portion 51. When the recorded tracks are reproduced, the audio signals reproduced in the respective tracks are output from the DAW 7 and are transmitted from output ports of a transmission port portion 52 that are connected to the respective tracks. The audio signals for the 36 channels transmitted from the transmission port portion 52 are supplied to the input port portion 41 of the mixer 1 via the audio network 20. Thus, VSC explained above becomes available. The reception port portion 51, the DAW 7, and the transmission port portion 52 of the PC 6 are set as follows. In an instance where audio signals that have been transmitted from one output port of the output port portion 44 of the mixer 1 having a certain number and that have been recorded in one track of the DAW 7 are reproduced in the one track and are transmitted form the PC 6, the audio signals are received by the input port of the input port portion 41 of the mixer 1 having the same number. In this instance, there exists one track in the DAW 7 for each number of the ports of the output port portion 44 and the input port portion 41 of the mixer 1.

In VSC, when one input port is patched to one input channel in the sub input patch portion 42 such that audio signals of one track of the DAW 7 are supplied to one input channel of the input channel portion 33, it is necessary, in real performance, to supply the audio signals of the one input channel to the one track and to record them in the one track, prior to VSC. To this end, direct-out of the one input channel is patched in the sub output patch portion 43 to one output port of the output port portion 44 from which audio signals are to be transmitted to the one track, for supplying, to the same one track, the audio signals processed in the one input channel in real performance. Thereafter, recording in real performance is conducted. In the present embodiment, one input channel that is patched in the sub input patch portion 42 to one input port having a certain number is patched in the sub output patch portion 43 to one output port having the same number.

Figure 4:
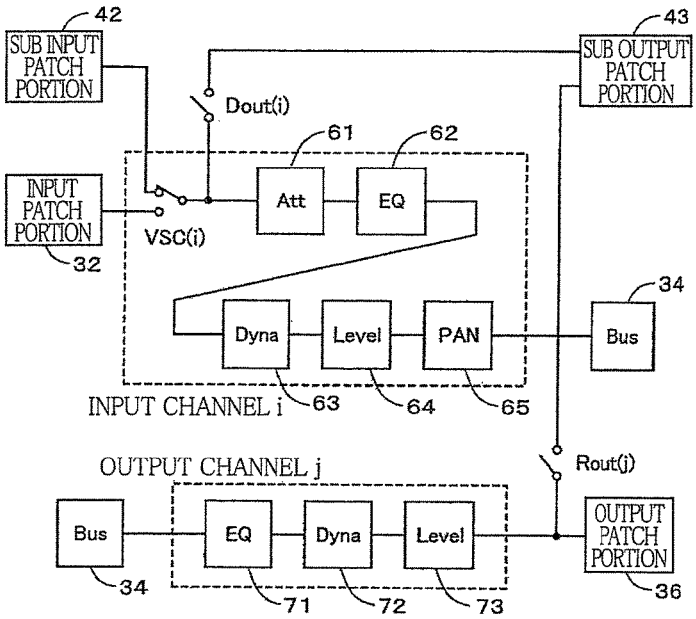
FIG. 4 is a block diagram showing detailed configurations of one input channel and one output channel in the mixer according to the embodiment of the invention.

FIG. 4 shows detailed configurations of one input channel i and one output channel j in the mixer 1 according to the present embodiment. All of the input channels have the same configuration as the input channel i, and all of the output channels have the same configuration as the output channel j.

As shown in FIG. 4, the input channel i is constituted by a VSC(i), an Att 61, an EQ 62, a Dyna 63, a Level 64, and a PAN 65 which are connected to one another in cascade. The VSC(i) is a switch for virtual soundcheck provided for each input channel. When the VSC(i)=0, the switch is switched downward, so that the audio signals from the input patch portion 32 are to be processed in the input channel i. When the VSC(i)=1, the switch is switched upward, so that the audio signals from the sub input patch portion 42 are to be processed in the input channel i. The Att 61 is an attenuator for adjusting an attenuation amount of the input audio signals. The EQ 62 is an equalizer for adjusting frequency characteristics of the audio signals. The Dyna 63 is a dynamics for changing a dynamic range of the audio signals. The Level 64 is a fader for individually adjusting a transmission level of the audio signals to buses of the bus 34. The PAN 65 is a pan for setting sound image location when the audio signals are output to stereo bus. The adjustment of the fader is performed by user's operations on the electric F 14. The audio signals that have been subjected to signal processing in the input channel i are supplied to the bus 34.

The output channel j is constituted by an EQ 71, a Dyna 72, and a Level 73 which are connected to one another in cascade. To the output channel j, mixed audio signals are input from the corresponding bus of the bus 34. The audio signals that have been subjected to signal processing in the output channel j are supplied to the output patch portion 36 and a switch Rout(i). The EQ 71 of the output channel j is an equalizer for adjusting frequency characteristics of the audio signals output from the bus 34. The Dyna 72 is a dynamics for changing a dynamic range of the audio signals output from the bus 34. The Level 73 is a fader for adjusting an output level of the audio signals. The Rout(j) is a switch for recording. When the Rout(j)=1, the same audio signals as those processed in the output channel j and supplied to the output patch portion 36 are supplied to the sub output patch portion 43. When the audio signals are transmitted to the DAW 7 via the output port portion 44, the audio signals can be recorded. When the Rout(j)=0, the audio signals processed in the output channel j are not supplied to the sub output patch portion 43.

A switch Dout(i) connected on the front side of the Att 61 is a switch for direct-out. When the Dout(i)=1, the same audio signals as those processed in the input channel i are supplied to the sub output patch portion 43. When the Dout(i)=0, the audio signals are not supplied to the sub output patch portion 43.

Figure 5:
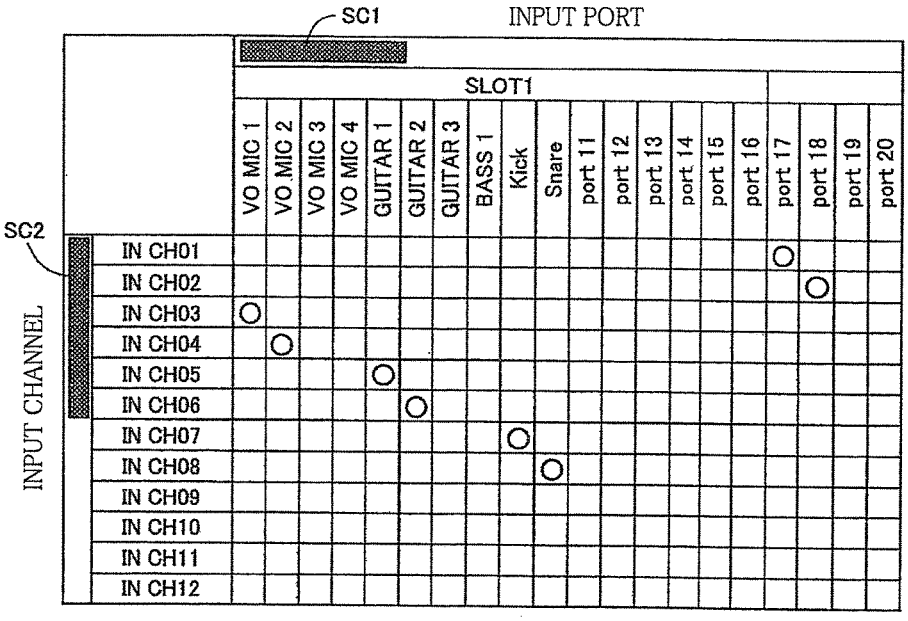
FIG. 5 is a view showing an input patch setting screen in the mixer according to the embodiment of the invention.

FIG. 5 shows the input patch setting screen on which one input port of the input port portion 31 is patched in the input patch portion 32 to one input channel of the input channel portion 33. The input patch setting screen is displayed on the P display 13 in accordance with user's screen selection.

The input patch setting screen shown in FIG. 5 is a screen for making setting of the input patch portion 32. The input patch setting screen includes a grid including: columns of input ports, as patch sources, arranged in the horizontal direction; and rows of input channels, as patch destinations, arranged in the vertical direction. Names of the input channels of the input channel portion 33 are listed in the rows while names of the input ports of the input port portion 31 are listed in the columns. In a left-side row section of the grid (in which the names of the input channels are listed), the names of all of the input channels (e.g., 32 channels) of the input channel portion 33 are displayed in order in the vertical direction, such that the 32 input channels are displayed in respective 32 cells. In the illustrated example, there are displayed "IN CH01"-"IN CH12" in order. In this case, "IN CH01" is the name of the first input channel. For subsequent input channels, names are set such that last two-digit numerical values in each name are incremented by one. By moving a scroll bar SC2 downward, the names of the input channel "IN CH13" and its subsequent channels are displayed in the left-side row section of the screen.

The input port portion 31 that includes the first group of input ports includes 96 ports of SLOT1-SLOT6 (each having 16 ports). The 96 ports of SLOT1-SLOT6 are the input ports of the first group. Names of the 96 input ports are displayed in a column section of the screen in order in the horizontal direction, such that the 96 input ports are displayed in respective 96 cells. In the illustrated example, there are displayed "VO MIC 1"-"VO MIC 4", "GUITAR 1", "GUITAR 2", "BASS 1", "Kick", "Snare", "port 11"-"port 16" which are names of 16 ports set for SLOT1 and "port 17"-"port 20" which are names of 4 ports among 16 ports set for SLOT2. In the illustrated example, the names of the input ports are names of microphones and musical instruments connected to the input ports, such as vocal microphones, guitars, a bass, and drums. By moving a scroll bar SC1 rightward, there are displayed, in the column section of the screen, names of 12 ports of SLOT2 including "port 21" and its subsequent ports and names of 16 input ports of each of SLOT3-SLOT6.

For patching one input port to one input channel in the setting of the input patch portion 32, the user places a pointer on a cell of the grid of the input patch setting screen at which the row of the input channel of the patch destination and the column of the input port of the patch source intersect, and clicks the cell. As a result, the input port of the patch source is patched to the input channel of the patch destination, and a symbol "O" indicative of the patch is displayed at the cell of the grid ("ON" operation). In the illustrated example, the input port "port 17" of SLOT2 is patched to the input channel "IN CH01", the input port "port 18" of SLOT2 is patched to the input channel "IN CH02", the input port "VO MIC 1" of SLOT1 is patched to the input channel "IN CH03", the input port "VO MIC 2" of SLOT1 is patched to the input channel "IN CH04", and the input port "GUITAR 1" of SLOT1 is patched to the input channel "IN CH05". Although the input channels "IN CH09"-"IN CH12" are not patched to any of the currently displayed input ports, there is a possibility that those input channels are patched to any of currently invisible input ports.

Only one input port can be patched to each input channel. When the user clicks a cell at which an input channel is already patched to an input port for patching another port to the input channel in question, the already set patch is cancelled and new patch is set. In this case, the symbol "O" at the cell corresponding to the already set patch is erased, and the symbol "O" is displayed at a cell, at which the row of the input channel and the column of another input port intersect, corresponding to the newly set patch ("ON operation"). When the user places a pointer on a cell at which the symbol "O" is being displayed and clicks the cell, the patch between the input channel and the input port is cancelled and the symbol "O" at the cell is erased ("OFF operation"). According to patching, the audio signals of the patch-source input ports are supplied to the patch-destination input channels that are patched to the corresponding input ports.

In the present embodiment, patch data IPD is recorded in the ROM-RAM (memory) 11 for each of the patch-destination input channels. The patch data IPD is information indicative of patch of one patch-source input port to one patch-destination input channel. Specifically, where "i" is defined as identification information (ID) of one input channel and "p" is defined as identification information (ID) of one input port, the position of the cell is represented by coordinates (i, p). When the user performs the ON operation on one cell (i, p), "p" that is ID of the input port is recorded in the patch data IPD (i) of the input channel i of the input patch portion 32. The patch data IPD is recorded for each patch-destination input channel. The patch data IPD is information in which one patch-destination input channel is patched to one patch-source input port in the input patch portion 32. When the user performs the OFF operation on one cell (i, p), "null" indicative of no connection is recorded in the patch data IPD(i) of the input patch portion 32. It is noted that ID of the input channel can be set as the number of the input channel and ID of the input port can be set as the number of the input port.

In the input patch setting screen shown in FIG. 5, the user can visually confirm with ease whether one input port is patched to one input channel by presence or absence of the symbol "O" at a cell of the grid at which the row of the input channel and the column of the input port intersect each other.

Figure 6:
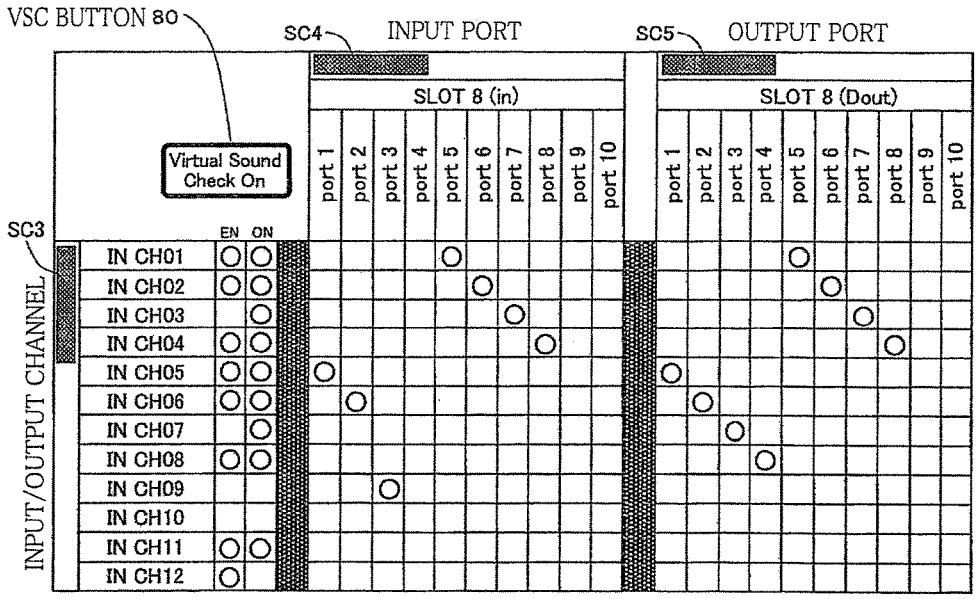
FIG. 6 is a view showing a recorder patch setting screen in the mixer according to the embodiment of the invention.

FIG. 6 shows the recorder patch setting screen displayed on the P display 13 in accordance with user's screen selection when (1) setting is made in the sub input patch portion 42 for patching the input channels of the input channel portion 33 to the input ports of the input port portion 41 and (2) setting is made in the sub output patch portion 43 for patching the ports of the output port portion 44 to direct-out of the input channels of the input channel portion 33 or to the output channels of the output channel portion 35.

The recorder patch setting screen shown in FIG. 6 includes a left-side sub input patch setting screen and a right-side sub output patch setting screen. The left-side sub input patch setting screen includes a grid including: columns of input ports, as patch sources, arranged in the horizontal direction; and rows of input/output channels, as patch destinations, arranged in the vertical direction. Names of the input channels of the input channel portion 33 or names of the output channels of the output channel portion 35 are listed in the rows while names of the input ports of the input port portion 41 are listed in the columns. The right-side sub output patch setting screen includes a grid including: rows of input/output channels, as patch sources, which are common to those in the sub input patch setting screen and which are arranged in the vertical direction; and columns of output ports, as patch destinations, arranged in the horizontal direction. Names of the input channels of the input channel portion 33 or names of the output channels of the output channel portion 35 are listed in the rows while names of the output ports of the output port portion 44 are listed in the columns. When a scroll bar SC3 is moved downward in a left-side row section common to the sub input patch setting screen and the sub output patch setting screen, names of the output channels (e.g., 12 channels) are displayed in order in the left-side row section, following the input channels (e.g., 32 channels). As shown in FIG. 3, there is no connection between the output channel portion 35 and the sub input patch portion 42. Thus, in an area of the recorder patch setting screen corresponding to the output channels, cells are displayed only in the sub output patch setting screen, and no cells are displayed in the sub input patch setting screen (blank area).

There are provided, on the right side of the row section, "EN" buttons (each as one example of a first indication) and "ON" buttons (each as one example of a second indication). The "EN" button is for setting enabling or disabling of the switching described above for each input channel. The enabled state is indicated by "O" while the disabled state is indicated by a blank " ". In other words, the "EN" button is for displaying, for each input channel, whether the switching set for each input channel is enabled or disabled distinguishably in different forms. In an area corresponding to the rows of the input channels, the "ON" button functions as a button for turning on and off the Dout switch provided in the route from the input channel to the sub output patch portion 43. In an area corresponding to the rows of the output channels, the "ON" button functions as a button for turning on and off the Rout switch provided in the route from the output channel to the sub output patch portion 43. The ON state is indicated by "O" while the OFF state is indicated by a blank " ". In other words, the "ON" button is for displaying, distinguishably in different forms, whether the audio signals supplied to the input channel are output directly to the output port patched to the input channel. Further, a VSC button 80 is provided on the upper left of the recorder patch setting screen. The VSC button 80 (as one example of a mode indication) is a button for turning on and off VSC. The VSC button 80 is illustrated such that "Virtual Sound Check On" is displayed in a rectangular frame. When VSC is turned on, the operation mode becomes the check mode. When VSC is turned off, the check mode is switched to the normal mode. The illustrated example shows a state in which the VSC button 80 is lit and VSC is on (the check mode). When VSC is off (the normal mode), the VSC button 80 is not lit. In other words, the VSC button 80 is for displaying, distinguishably in different forms, whether a currently selected mode is the normal mode or the check mode.

The input port portion 41 that includes a second group of input ports includes 36 input ports of SLOT8(in). Names of the 36 input ports are displayed in a column section of the sub input patch setting screen in order in the horizontal direction, such that the 36 input ports are displayed in respective 36 cells. In the illustrated example, there are displayed in order "port 1"-"port 10" which are names of 10 ports among the 36 ports of SLOT8(in). By moving a scroll bar SC4 rightward, there are displayed, in the column section of the sub input patch setting screen, names of 26 ports including "port 11" and its subsequent ports of SLOT8(in).

The output port portion 44 includes 36 output ports of SLOT8(Dout). Names of the output ports are displayed in a column section of the sub output patch setting screen in order in the horizontal direction, such that the 36 output ports are displayed in respective 36 cells. In the illustrated example, there are displayed in order "port 1"-"port 10" which are names of 10 output ports among the 36 ports of SLOT8(Dout). By moving a scroll bar SC5 in the horizontal direction, there are displayed, in the column section of the sub output patch setting screen, names of 26 ports including "port 11" and its subsequent ports of SLOT8(Dout).

For patching one input port to one input channel in the sub input patch portion 42, the user places a pointer on a cell of a grid in the sub input patch setting screen at which the row of the patch-destination input channel and the column of the patch-source input port, to which the input channel is to be patched, intersect each other, and clicks the cell. As a result, the input port is patched to the input channel, and the symbol "O" indicative of patch is displayed at the cell. In the illustrated example, the input port "port 5" of SLOT8(in) is patched to the input channel "IN CH01", the input port "port 6" of SLOT8(in) is patched to the input channel "IN CH02", the input port "port 7" of SLOT8(in) is patched to the input channel "IN CH03", and the input port "port 8" of SLOT8(in) is patched to the input channel "IN CH04". Although the input channels "IN CH07", "IN CH08", and "IN CH10"-"IN CH12" are not patched to any of the currently displayed input ports, there is a possibility that those input channels are patched to any of currently invisible input ports that will become visible by scrolling in the horizontal direction.

For patching one input channel or one output channel to one output port in the sub output patch portion 43, the user places a pointer on a cell of a grid in the sub output patch setting screen at which the row of the patch-source input channel or output channel and the column of the patch-destination output port, to which the input channel or the output channel is to be patched, intersect each other, and clicks the cell. As a result, the patch-source input channel or output channel is patched to the patch-destination output port, and the symbol "O" indicative of patch is displayed at the cell. In the illustrated example, the output port "port 5" of SLOT8(Dout) is patched to the input channel "IN CH01", the output port "port 6" of SLOT8(Dout) is patched to the input channel "IN CH02", the output port "port 7" of SLOT8(Dout) is patched to the input channel "IN CH03", and the output port "port 8" of SLOT8(Dout) is patched to the input channel "IN CH04". Although the input channels "IN CH09"-"IN CH12" are not patched to any of the currently displayed output ports, there is a possibility that those input channels are patched to any of currently invisible output ports.

In the recorder patch setting screen, it is possible to cancel already-set (previously-set) patch and to subsequently set new patch. It is also possible to cancel already-set patch. The setting arrangement in the recorder patch setting screen is similar to that in the input patch setting screen explained above. According to patching in the recorder patch setting screen, the audio signals of the patched input port are supplied to the patch-destination input channel, and the audio signals of the patch-source input channel or output channel patched to the output port are supplied to the patch-destination output port.

When the user performs manual setting in which one input port (that receives the audio signals from one track) is patched to one input channel as a result of an operation on the sub input patch setting screen, automatic setting is performed on the sub output patch setting screen in which one output port that corresponds to the one input port (and that transmits the audio signals to the same one track) is patched to the one input channel, in conjunction with the patching of the one input port to the one input channel. Further, when the user performs manual setting in which one input channel is patched to one output port (that transmits the audio signals to one track) as a result of an operation on the sub output patch setting screen, automatic setting is performed on the sub input patch setting screen in which the input port that corresponds to the one output port (and that receives the audio signals from the same one track) is patched to the one input channel, in conjunction with the patching of the one input channel to the one output port. In an instance where the user performs a setting operation while holding a shift button (in the P controls 12) down, the automatic setting is not performed, and there is only performed the manual setting of one of the sup input patch setting screen and the sub output patch setting screen which is operated by the user. By pressing another button while holding the shift button down, the shift button causes a function of another button to be changed (shifted) to other function thereof.

As explained above, the 36 tracks of the DAW 7, as the supply source of the audio signals received by the input ports "port 1-port 36" of SLOT8(in) of the input port portion 41, are the same as the 36 tracks of the DAW 7 to which are supplied the audio signals transmitted from the output ports "port 1-port 36" of SLOT8(Dout) of the output port portion 44. In this sense, the input ports "port 1-port 36" of SLOT8(in) and the output ports "port 1-port 36" of SLOT8(Dout) have a one-to-one correspondence relationship. For instance, when the user performs, on the not-yet-set sub input patch setting screen, an operation for patching the input ports "port 5", "port 6", and "port 7" of SLOT8(in) respectively to the input channels "IN CH01", "IN CH02", and "IN CH03", the input channels "IN CH01", "IN CH02", and "IN CH03" are automatically patched respectively to the output ports "port 5", "port 6", and "port 7" of SLOT8(Dout) in conjunction with the patching of the input ports "port 5-port 7" to the input channels "IN CH01"-"IN CH03" if the shift button is not held down.

On the other hand, when the user performs a setting operation on the sub output patch setting screen for patching the output port "port 1" of SLOT8(Dout) to the input channel "IN CH05" without holding the shift key down, the input channel "IN CH05" is automatically patched to the input port "port 1" of SLOT8(in) in conjunction with the patching of the output port "port 1" to the input channel "IN CH05".

As explained above, setting for patching one input port as the patch source to one input channel as the patch destination and setting for patching the one input channel as the patch source to one output port as the patch destination corresponding to the one input port are automatically made in conjunction with each other in a bidirectional manner. The setting for virtual soundcheck may be made on one of the sub input patch setting screen and the sub output patch setting screen.

In the present embodiment, patch data SIPD is recorded in the ROM-RAM (memory) 11 for each of the patch-destination input channels in the sub input patch portion 42. The patch data SIPD is information indicative of patch of one patch-source input port to one patch destination input channel. Specifically, where "i" is defined as identification information (ID) of one input channel and "p" is defined as ID of one input port, the position of the cell on the sub input patch setting screen is represented by coordinates (i, p). When the user performs the ON operation on one cell (i, p) in the sub input patch setting screen, "p" that is ID of the input port is recorded in the patch data SIPD(i) of the input channel i of the sub input patch portion 42, and the symbol "O" is displayed at the cell (i, p). If the shift button is not held down in the ON operation, the setting for patching the input channel i to the output port corresponding to the input port p is automatically made in conjunction with the patching of the input port p to the input channel i. Where ID of the output port corresponding to the input port p is defined as "px", "i" that is ID of the input channel is recorded in patch data SOPD(px) of the output port px of the sub output patch portion 43, and the symbol "O" is displayed at the corresponding cell (i, px). When the user performs the OFF operation on one cell (i, p), "null" indicative of no connection is recorded in the patch data SIPD(i) of the input channel i of the sub input patch portion 42, and the symbol "O" at the cell (i, p) is erased. If the shift button is not held down in the OFF operation, "null" is recorded also in the patch data SOPD(px) of the corresponding output port px, and the symbol "O" at the cell of the output port px is erased.

Further, patch data SOPD is recorded in the ROM-RAM (memory) 11 for each of the patch-destination output ports in the sub output patch portion 43. The patch data SOPD is information indicative of patch of one patch-source input channel or output channel to one patch-destination output port. Where "i" is defined as ID of one input channel and "p" is defined as ID of one output port, the position of the cell on the sub output patch setting screen is represented as coordinates (i, p). When the user performs the ON operation on one cell (i, p) on the sub output patch setting screen, "i" that is ID of the input channel is recorded in patch data SOPD(p) of the output port p of the sub output patch portion 43, and the symbol "O" is displayed at the cell (i, p). If the shift button is not held down in the ON operation, the CPU 10 performs automatic setting in which the input port corresponding to the output port p is patched to the input channel i, in conjunction with the patching of the input channel i to the output port p. Where "px" is defined as ID of the input port corresponding to the output port p, "px" is recorded in patch data SIPD(i) of the input channel i of the sub input patch portion 42, and the symbol "O" is displayed at the corresponding cell (i, px). In an instance where the user performs the ON operation on one cell (i, p) in the area of the output channels, "i" represents ID of one output channel In this instance, "i" that is ID of the output channel is recorded in patch data SOPD(p) of the output port p of the sub output patch portion 43, and the symbol "O" is displayed at the corresponding cell (i, p). When the user performs the OFF operation on one cell (i, p), "null" indicative of no connection is recorded in the patch data SOPD(p) of the output port p of the sub output patch portion 43, and the symbol "O" at the cell (i, p) is erased. If the shift button is not held down in the OFF operation, "null" is recorded also in the patch data SIPD(i) of the input channel i, and the symbol "O" at the cell of the input channel i is erased.

As explained above, the input ports "port 1-port 36" of SLOT8(in) of the input port portion 41 and the output ports "port 1-port 36" of SLOT8(Dout) of the output port portion 44 have a one-to-one correspondence in relation to the 36 tracks of the DAW 7 in which the audio signals are recorded/reproduced. Consequently, one input port and one output port that correspond to each other differ in ID but have the same port number in respective slots. One input port and one output port that correspond to each other are located at the respective corresponding cell positions (XY coordinates) of the sub input patch setting screen and the sub output patch setting screen. Thus, the user can easily confirm and change the patch setting for VSC even without the above-indicated bidirectional patching.

In the recorder patch setting screen shown in FIG. 6, only cells at each of which the port relevant to virtual soundcheck and the input channel intersect are displayed, and operations at least on those cells are necessary. Consequently, the setting for virtual soundcheck can be made without considering other ports irrelevant to virtual soundcheck. The sub input patch is for setting patch that is to be switched to patch of the input channels set in the input patch, and it is possible to set the patch in the sub input patch independently of the input patch. The sub output patch is for setting patch of the output ports that are not dealt with in the output patch, and it is possible to set the patch in the sub output patch independently of the output patch.

The VSC button 80 is provided on the recorder patch setting screen. When the VSC button 80 is turned on to establish the check mode, the user can easily recognize that audio signals reproduced in the DAW 7 are input to which input channel, in the check mode in which the mixer 1 is to be operated. After the check mode has been established, the user can easily change the supply destination of the audio signals from the DAW 7 to different input channels. The setting in the sub input patch portion 42 and the sub output patch portion 43 on the recorder patch setting screen can be changed also in the check mode (VSC=1), and the change is immediately reflected in signal processing. It is thus easy to change setting of the audio signal processing device in accordance with the performer present on the spot when virtual soundcheck is being conducted.

Figure 7:
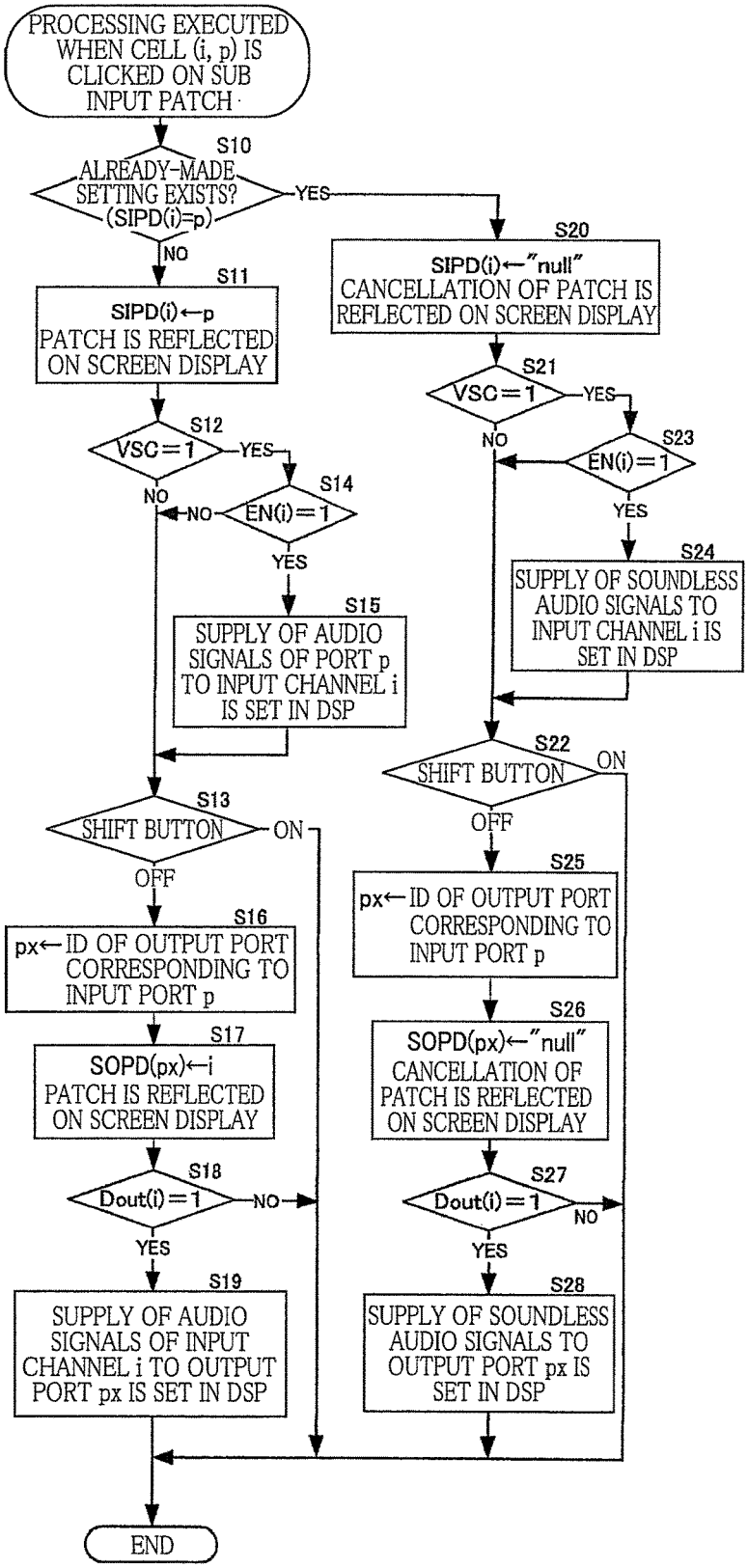
FIG. 7 is a flow chart of setting processing executed when a click operation is made on a cell of a sub input patch on the recorder patch setting screen in the mixer according to the embodiment of the invention.

FIG. 7 shows a flow chart of setting processing for patching the input ports to the input channels on the sub input patch setting screen in accordance with user's operations. The setting processing is executed by the CPU 10 when the user places a pointer on a cell of the grid (i, p) on the sub input patch setting screen of FIG. 6 and clicks the cell. Here, "i" represents ID of the input channel i, and "p" represents ID of the input port p of the input port portion 41.

When the setting processing is started upon the operation on the cell (i, p), the CPU 10 determines at step S10 whether there exists already-made (previously-made) setting at the cell (i, p). When "p" (ID of the input port p) is not recorded in the patch data SIPD(i) of the input channel i of the sub input patch portion 42 and the CPU 10 accordingly determines that no already-made setting exists at the cell (i, p) and therefore determines that the user has performed the ON operation on the cell (i, p) (S10: NO), the control flow goes to step S11 at which the CPU 10 records "p" in the patch data SIPD(i) of the cell (i, p) of the sub input patch portion 42 and the input port p is patched to the input channel i. The patch is reflected on the recorder patch setting screen by displaying the symbol "O" at the cell. Also when the input port other than the input port p is already patched to the input channel i, the control flow goes to step S11 at which the CPU 10 cancels the already-made patch and erases the symbol "O" at the cell corresponding to the patch, and the above-indicated processing of step S11 is executed. The CPU 10 then determines at step S12 whether VSC is on (VSC=1). When the CPU 10 determines that VSC=1 (the check mode) (S12: YES), the control flow goes to step S14 at which the CPU 10 determines whether switching of the input channel i is enabled (EN(i)=1). When the CPU 10 determines that EN(i)=1 (S14: YES), the control flow goes to step S15 at which the CPU 10 makes setting with respect to the DSP 16 such that the audio signals from the input port p of the input port portion 41 are supplied to the Att 61, the EQ 62, the Dyna 63, the Level 64, and the PAN 65 (which are a signal processor) of the input channel i. This corresponds to a state in which the VSC(i) switch is switched upward (VSC(i)=1) in FIG. 4. The VSC(i) switch becomes "1" when the mixer 1 operates in the check mode (VSC=1) and switching of the input channel i is enabled (EN(i)=1) while the VSC(i) switch becomes "0" in other case. Thus, the DSP 16 can execute, in the input channel i, signal processing for controlling the frequency characteristics and the level of the audio signals from the input port p.

When the CPU 10 determines at step S12 that VSC=0 (the normal mode) (S12: NO), when the CPU 10 determines at step S14 that EN(i)=0 (switching is disabled) (S14: NO), or when step S15 is ended, the CPU 10 determines at step S13 whether the shift button, which is one of the P controls 12, is being held down. When the CPU 10 determines that the shift button is not being held down (off), the control flow goes to step S16 at which the CPU 10 stores, as a variable px, ID of the output port of the output port portion 44 that corresponds to the input port p of the input port portion 41. This output port is represented as an output port px. As explained above, the output port that corresponds to the input port p is defined as follows. In an instance where audio signals, which have been sent from the output port px and have been recorded in the DAW 7, are reproduced and are input to the input port p from the DAW 7, the output port px is the output port that corresponds to the input port p. After step S16, the control flow goes to step S17 at which the CPU 10 records "i" (ID of the input channel i patched to the input port p) in the patch data SOPD(px) of the output port px of the sub output patch portion 43 and patches the output port px to the input channel i. The patch is reflected on the recorder patch setting screen by displaying the symbol "O" at the cell. In an instance where the input port other than the input port p is already patched to the output port px, the patch is cancelled at S17 and the symbol "O" at the cell corresponding to the patch is erased. After step S17, the control flow goes to step S18 at which the CPU 10 determines whether the switch for direct-out is on (Dout(i)=1). When the CPU 10 determines that Dout(i)=1 (S18: YES), the control flow goes to step S19 at which the CPU 10 make setting with respect to the DSP 16 such that the audio signals of direct-out of the input channels i are supplied to the output port px. This corresponds to a state in which the Dout(i) switch is on in FIG. 4.

When the CPU 10 determines at S10 that p (ID of the input port) is already recorded in the patch data SIPD(i) and therefore determines that the user has performed the OFF operation on the cell (i, p) for cancelling the already-made setting (S10: YES), the control flow goes to step S20 at which the CPU 10 records "null" in the patch data SIPD(i) of the sub input patch portion 42 and cancels the patch of the input port p to the input channel i. The cancellation of the patch is reflected on the sub input patch setting screen by erasing the symbol "O" displayed at the cell. The CPU 10 then determines at step S21 whether VSC is on (VSC=1). When the CPU 10 determines that VSC=1 (the check mode) (S21: YES), the control flow goes to step S23 at which the CPU 10 determines whether switching for the input channel i is enabled (EN(i)=1). When the CPU 10 determines that EN(i)=1 (S23: YES), the control flow goes to step S24 at which the CPU 10 makes setting with respect to the DSP 16 such that soundless audio signals are supplied to the input channel i because the input channel i is not patched to any of the input ports.

When the CPU 10 determines at step S21 that VSC=0 (the normal mode) (S21: NO), when the CPU 10 determines at step S23 that EN(i)=0 (switching is disabled) (S23: NO), or when step S24 is ended, the CPU 10 determines at step S22 whether the shift button is being held down (on) or not (off). When the CPU 10 determines that the shift button is not being held down (off), the control flow goes to step S25 at which the CPU 10 stores, as a variable px, ID of the output port that corresponds to the input port p. Subsequently at step S26, the CPU 10 records "null" in the patch data SOPD(px) of the output port px of the sub output patch portion 43 and cancels the patch of the input channel i to the output port px. The cancellation of the patch is reflected on the recorder patch setting screen by erasing the symbol "O" displayed at the cell (i, px). After step S26, the CPU 10 determines at step S27 whether the switch for direct-out is on (Dout(i)=1). When the CPU 10 determines that Dout(i)=1 (S27: YES), the control flow goes to step S28 at which the CPU 10 makes setting with respect to the DSP 16 such that soundless audio signals are supplied to the output port px because the output port px is not patched to any of the input channels.

When the CPU 10 determines at step S13 or step S22 that the shift button is being held down, when the CPU 10 determines at step S18 or step S27 that Dout(i)=0 (S18 or S27: NO), or when step S19 or step S28 is ended, the setting routing is ended.

According to the setting processing described above, when the user performs the ON operation on the cell (i, p) of the sub input patch setting screen, an input port p is patched to the input channel i in the sub input patch portion 42. In this instance, when the operation mode is the check mode (VSC=1) and switching for the input channel i is enabled (EN(i)=1), the audio signals from the DAW 7 received by the input port p are immediately supplied to the input channel i. If the shift button is not being held down at this time, the output port px that corresponds to the input port p is patched to the input channel i in the sub output patch portion 43, in conjunction with the patching of the input port p to the input channel i. When direct-out of the input channel i is on (Dout(i)=1), the audio signals before being processed in the input channel i are sent to the DAW 7 from the output port px. If the audio signals sent from the output port px are recorded in the DAW 7 at the time of real performance in a certain hall or venue, the audio signals can be reproduced in the DAW 7 and the reproduced audio signals can be received by the input port p, in audio adjustment conducted thereafter in another hall or venue. In an instance where the user sets switching for the input channel i to be enabled, the audio signals from the input port p are supplied to the signal processor (61-65) of the input channel i and the DSP 16 executes, in the input channel i, signal processing for controlling the frequency characteristics and the level of the audio signals recorded in real performance. In an instance where the user sets switching for the input channel i to be disabled, the audio signals from the input port of real performance patched in the input patch portion 32 are supplied to the signal processor (61-65) of the input channel i. In this case, the DSP 16 executes, in the input channel i, signal processing for controlling the frequency characteristics and the level of the audio signals from the input port. As explained above, the ON operation and the OFF operation on the grid are performed in a toggle manner. When the patch of the input port p to the input channel i is canceled in the sub input patch portion 42 by the OFF operation on the sub input patch setting screen, the patch of the input channel i to the output port px that corresponds to the input port p is automatically cancelled in the sub output patch portion 43, in conjunction with the cancellation of the patch of the input port p to the input channel i if the shift button is not being held down. At step S26, the patch is cancelled irrespective of to which input channel the output port px is patched. In this respect, the patch may be cancelled only when the output port px is connected to the input channel i. Further, patching of the input port p to the input channel i and patching of the input channel i to the output port px are made in conjunction with each other while cancellation of patching of the input port p to the input channel i and cancellation of patching of the input channel i to the output port px need not be necessarily made in conjunction with each other.

In an instance where the cell (i, p) is operated on the sub output patch setting screen, there is executed substantially the same processing as that when the input port is substituted by the output port in the setting processing shown in FIG. 7. When the user performs the ON operation on the cell (i, p), the input channel i is patched to the output port p in the sub output patch portion 43, and the audio signals processed in the input channel i (the audio signals before being processed) are directly supplied to the output port p if direct-out of the input channel i is on (Dout(i)=1). If the shift button is not being held down at this time, the input channel i is patched to the input port px that corresponds to the output port p in the sub input patch portion 42, in conjunction with the patching of the input channel i to the output port p. If the audio signals sent from the output port p are recorded in the DAW 7 at the time of real performance in a certain hall or venue, the audio signals can be reproduced in the DAW 7 and the reproduced audio signals can be received by the input port px, in audio adjustment conducted thereafter in another hall or venue. In an instance where the user sets switching for the input channel i to be enabled the audio signals from the input port px are supplied to the signal processor (61-65) of the input channel i and the DSP 16 executes, in the input channel i, signal processing for controlling the frequency characteristics and the level of the audio signals recorded in real performance. In an instance where the user sets switching for the input channel i to be disabled, the audio signals from the input port of real performance patched in the input patch portion 32 are supplied to the signal processor (61-65) of the input channel i. In this case, the DSP 16 executes, in the input channel i, signal processing for controlling the frequency characteristics and the level of the audio signals from the input port.

Figure 8:
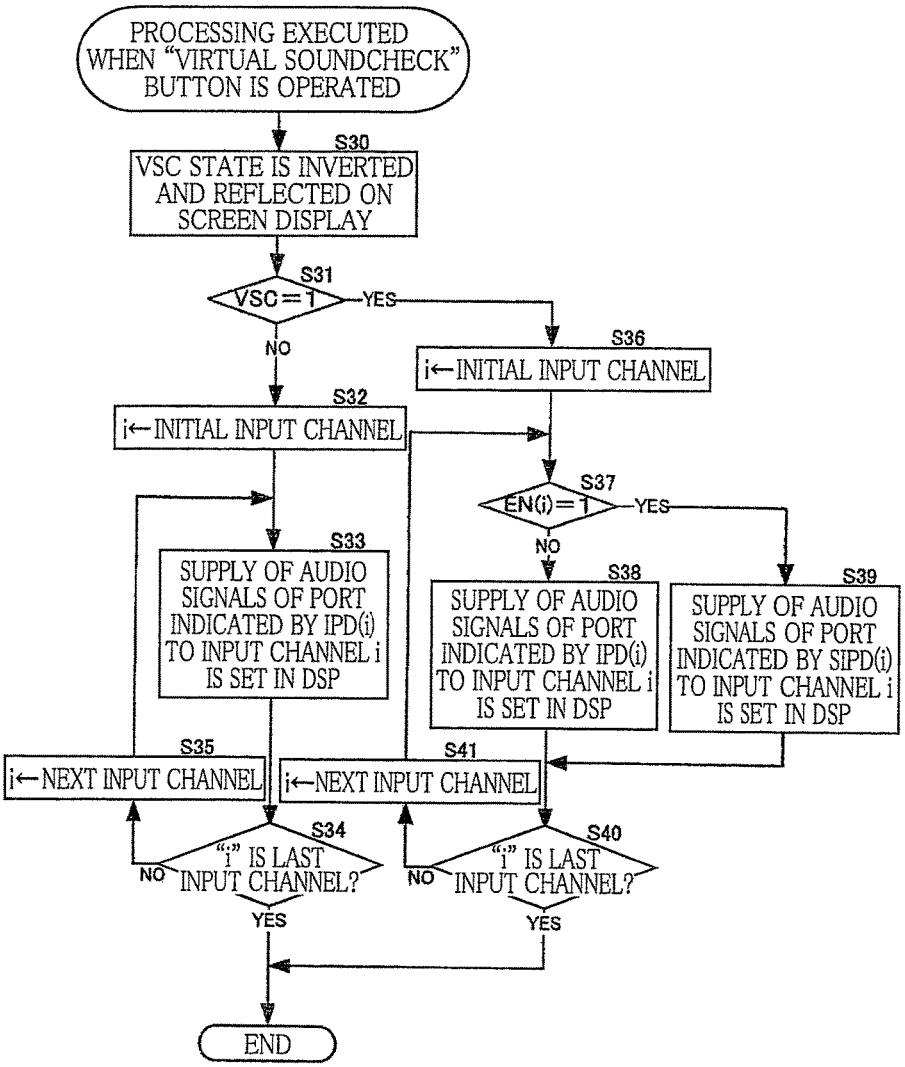
FIG. 8 is a flow chart of normal mode/check mode processing executed when a "virtual soundcheck" button is operated in the mixer according to the embodiment of the invention.

FIG. 8 shows a flow chart of normal mode/check mode processing. The CPU 10 executes the normal mode/check mode processing when the user operates the "virtual soundcheck" button (the VSC button 80) on the recorder patch setting screen. The VSC button 80 is indicated, on the recorder patch setting screen of FIG. 6, as a rectangular frame in which "Virtual Sound Check On" is displayed. The user places a pointer on the VSC button 80 and clicks the same 80, whereby VSC is turned on and off.

When the VSC button 80 is operated and the normal mode/check mode processing is started, the CPU 10 inverts the on/off state of VSC at step S30 and reflects it on the recorder patch setting screen. For instance, when VSC is on (VSC=1), the VSC button 80 is lit so as to indicate the check mode, as shown in FIG. 6. When the VSC is off (VSC=0), the VSC button 80 is turned out or grayed out so as to indicate the normal mode. After step S30, the CPU 10 determines at step S31 whether VSC=1. When the CPU 10 determines that VSC is off (VSC=0) (S31: NO), it means that the operation mode of the mixer 1 is the normal mode. In this case, the control flow goes to step S32 at which ID of an initial input channel is stored as a variable i. This input channel is represented as an input channel i. Subsequently at step S33, the CPU 10 makes setting with respect to the DSP 16 such that the audio signals from the input port of the input port portion 31 patched to the input channel i indicated by the patch data IPD(i) of the input patch portion 32 are supplied to the signal processor (61-65) of the input channel i. Thus, the DSP 16 can execute, in the input channel i, signal processing for controlling the frequency characteristics and the level of the audio signals from the input port connected in the input patch portion 32. After S33, the CPU 10 determines at S34 whether "i" is ID of a last input channel. When the CPU 11 determines that "i" is not ID of the last input channel (S34: NO), the control flow goes to step S35 at which ID of a next input channel is stored as a variable i, and returns to step S33. The above-indicated step S33 through step S35 are repeatedly executed for the next input channel i. When the CPU 10 determines at S34 that "i" is ID of the last input channel (S34: YES) as a result of repeated execution of step S33-step S35, the normal mode/check mode processing ends.

When the CPU 10 determines at step S31 that VSC is on (VSC=1) (S31: YES), it means that the operation mode of the mixer 1 is the check mode. In this case, the control flow goes to step S36 at which ID of an initial input channel is stored as a variable i. The CPU 10 subsequently determines at S37 whether switching for the input channel i is enabled (EN(i)=1). When the CPU 10 determines that EN(i)=0 (S37: NO), the control flow goes to step S38 at which the CPU 10 makes setting with respect to the DSP 16 such that the audio signals from the input port of the input port portion 31 patched to the input channel i indicated by the patch data IPD(i) of the input patch portion 32 are supplied to the signal processor (61-65) of the input channel i. Thus, the DSP 16 can execute, in the input channel i, signal processing for controlling the frequency characteristics and the level of the audio signals from the input port connected in the input patch portion 32. When the CPU 10 determines at step S37 that EN(i)=1 (S37: YES), the control flow goes to step S39 at which the CPU 10 makes setting with respect to the DSP 16 such that the audio signals from the input port of the input port portion 41 patched to the input channel i indicated by the patch data SIPD(i) of the sub input patch portion 42 are supplied to the signal processor (61-65) of the input channel i. Thus, the DSP 16 can execute, in the input channel i, signal processing for controlling the frequency characteristics and the level of the audio signals from the input port connected in the sub input patch portion 42. After step S38 or step S39, the CPU 10 determines at S40 whether "i" is ID of the last input channel. When the CPU 10 determines that "i" is not ID of the last input channel (S40: NO), the control flow goes to step S41 at which ID of a next input channel is stored as a variable i and returns to step S37. The above-indicated step S37 through step S41 are repeatedly executed for the next input channel i. When the CPU 10 determines at step S40 that "i" is ID of the last input channel (S40: YES) as a result of repeated execution of step S37 through step S41, the normal mode/check mode ends.

In the check mode (VSC=1), in the input channel i for which switching is set to be enabled, the patch setting in the sub input patch portion 42 is applied to selection of the audio signals processed in the DSP 16, in preference to the patch setting in the input patch portion 32. Further, in the input channel i for which switching is set to be disabled, the patch setting in the input patch portion 32 is applied to selection of the audio signals processed in the DSP 16. In the normal mode (VSC=0), in all of the input channels i, the patch setting in the input patch portion 32 is applied to selection of the audio signals processed in the DSP 16.

Figure 9:
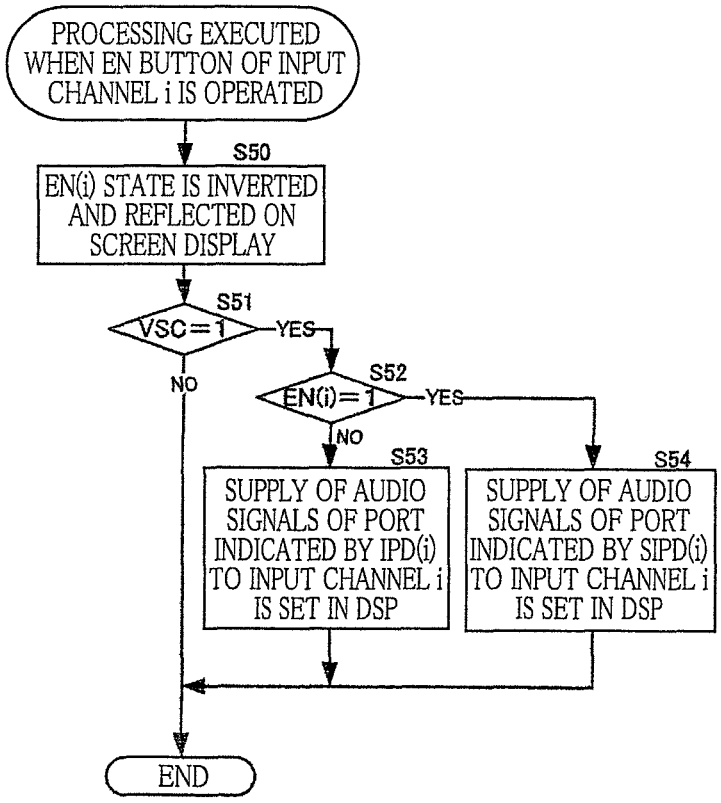
FIG. 9 is a flow chart of EN processing executed when an "EN" button is operated in the mixer according to the embodiment of the invention.

FIG. 9 shows a flow chart of EN processing executed by the CPU 10 when the user operates the "EN" button of the input channel i.

When the "EN" button of the input channel i is operated and the EN processing accordingly starts, the CPU 10 inverts the EN(i) state of the input channel i at step S50 and reflects the inverted state on the recorder patch setting screen by inverting mark indication of the input channel i. Then the CPU 10 determines at step S51 whether VSC=1. When the CPU 10 determines that VSC=1 (the check mode) (S51: YES), the control flow goes to step S52. The CPU 10 determines at step S52 whether switching for the input channel i is enabled (EN(i)=1). When the CPU 10 determines that EN(i)=0 (i.e., switching is disabled) (S51: NO), the control flow goes to step S53 at which the CPU 10 makes setting with respect to the DSP 16 such that the audio signals from the input port of the input port portion 31 patched to the input channel i indicated by the patch data IPD(i) of the input patch portion 32 are supplied to the signal processor (61-65) of the input channel i. Thus, the DSP 16 can execute, in the input channel i, signal processing for controlling the frequency characteristics and the level of the audio signals from the input port connected in the input patch portion 32. When the CPU 10 determines at S52 that EN(i)=1 (i.e., switching is enabled) (S52: YES), the control flow goes to step S54 at which the CPU 10 makes setting with respect to the DSP 16 such that the audio signals from the input port of the input port portion 41 patched to the input channel i indicated by the patch data SIPD(i) of the sub input patch portion 42 are supplied to the signal processor (61-65) of the input channel i. Thus, the DSP 16 can execute, in the input channel i, signal processing for controlling the frequency characteristics and the level of the audio signals from the input port connected in the sub input patch portion 42. When the CPU 10 determines at step S51 that VSC=0 (the normal mode) (S51: NO) or when step S53 or step S54 ends, the EN processing ends.

When virtual soundcheck is on (i.e., in the check mode), in the input channel i for which switching is set to be enabled, the patch setting in the sub input patch portion 42 is applied to selection of the audio signals processed by the DSP 16, in preference to the patch setting in the input patch portion 32. Further, in the input channel i for which switching is set to be disabled, the patch setting in the input patch portion 32 is applied to selection of the audio signals processed by the DSP 16.

In the illustrated embodiment, a part of the input ports are connected to the sub input patch, and the rest is connected to the input patch, to thereby clarify the input ports for virtual soundcheck and obviating misoperations by the user. However, all of the input ports may be connected to both of the sub input patch and the input patch without making such a distinction. Alternatively, the input ports may be classified into those connected to both of the patches and those connected to only one of the patches.

In the illustrated embodiment, the input ports connected to the sub input patch and the output ports connected to the sub output patch are determined in advance. The user may determine desired ports as the ports for virtual soundcheck. In this instance, the input ports determined by the user are connected to the sub input patch while the input ports not determined by the user are connected to the input patch, and the output ports determined by the user are connected to the sub output patch while the output ports not determined by the user are connected to the output patch. In the illustrated embodiment, the outlet of direct-out of the input channel is located only before the attenuator. The location of the outlet may be selected from among before the attenuator, before the equalizer, before the dynamics, a prefader, a posfader, and the like.

The illustrated embodiment shows only one direct-out route from the input channel to the sub output patch. A direct-out route from the input channel to the output patch may be provided. In the illustrated embodiment, the DAW application that operates on the OS of the PC establishes an external recorder. The recorder may be otherwise established, and any device or equipment that can perform multitrack recording/reproduction is available. In the illustrated embodiment, the input port and the output port having the same port number are defined as "corresponding ports" for simplifying explanation of the recorder patch setting screen. The "corresponding ports" may be defined otherwise. One input port that receives, from the PC, the audio signals of one track of the DAW and one output port that transmits, to the PC, the audio signals recorded in the same track may be the "corresponding ports". The "corresponding ports" may be changed as desired in accordance with setting on the recorder side (the DAW side).

In the illustrated embodiment, the names of the input channels are displayed in the vertical direction of the grid of each of the input patch setting screen and the recorder patch setting screen. The names of the input channels may be displayed in the horizontal direction. In this case, the names of the input ports or the output ports are displayed in the vertical direction of the grid instead of the horizontal direction, and the grid of the sub input patch and the grid of the sub output patch of the recorder patch setting screen are arranged in the vertical direction while having columns of "input/output channels" in common In the recorder patch setting screen of the illustrated embodiment, the grid of the sub input patch setting screen relating to the input ports and the grid of the sub output patch setting screen relating to the output ports are separately displayed respectively in the left-side area and the right-side area of the recorder patch setting screen. The input ports and the output ports may be alternately displayed such that one column of the input port and one column of the output port having the same port number are adjacent to each other in one grid, so as to provide a grid of one sub patch setting screen in which the sub input patch setting screen and the sub output patch setting screen are combined.

In the illustrated embodiment, the number of tracks of the MTR(DAW) connected to the mixer is larger than the number of the input channels of the mixer. The number of tracks of the MTR is not limited to a particular number, but may be larger or smaller than the number of the input channels. Further, the numbers of the input ports, the input channels, the buses, the output channels, and the output ports in the illustrated embodiment may be suitably changed.

The present invention provides an audio signal processing device, comprising: a plurality of input ports configured to receive audio signals; a plurality of channels configured to process audio signals; a first input patch configured to patch one of the input ports to one of the channels; a second input patch configured to patch one of the input ports to one of the channels and configured to set, for each of the channels, whether switching is enabled or disabled; and a mode selector configured to select one of a first mode and a second mode, wherein, when the first mode is selected, the one of the channels receives audio signals of the one of the input ports patched in the first input patch, and wherein, when the second mode is selected, the one of the channels for which the switching is set to be enabled receives audio signals of the one of the input ports patched in the second input patch while the one of the channels for which the switching is set to be disabled receives audio signals of the one of the input ports patched in the first input patch.

In the audio signal processing device constructed as described above, the first input patch may be configured to patch a first input port which is the one of the input ports to a first channel which is the one of the channels, the second input patch may be configured to patch a second input port which is the one of the input ports and which is different from the first input port to the first channel, and the second input patch may be configured to set whether the switching of the input port patched to the first channel from the first input port to the second input port is enabled or disabled.

In the audio signal processing device constructed as described above, the input ports may include a first group of input ports including the first input port and a second group of input ports including the second input port, the first input patch may be configured to patch one of the input ports of the first group to one of the channels, and the second input patch may be configured to patch one of the input ports of the second group to one of the channels.

The audio signal processing device constructed as described above may further comprise a display configured to display patching of the one of the input ports to the one of the channels in the first input patch.

The audio signal processing device constructed as described above may further comprise a display configured to display patching of the one of the input ports to the one of the channels in the second input patch.

In the audio signal processing device constructed as described above, the display may be configured to display the patching in the second input patch on a grid in which the input ports are displayed in one of a horizontal direction and a vertical direction while the channels are displayed in the other of the horizontal direction and the vertical direction, and when a cell of the grid at which one channel and one input port intersect is operated, the second input patch may patch the one input port to the one channel.

In the audio signal processing device constructed as described above, the display may be configured to display a setting screen for patching the one input port to the one channel in the second input patch, and the display may be configured to display, on the setting screen in the second input patch, names of the input ports in order in the horizontal direction, names of the channels in order in the vertical direction, and names of a plurality of output ports, to which the audio signals supplied to each of the channels are output directly, in order in the horizontal direction.

In the audio signal processing device constructed as described above, the display may be configured to display, on the setting screen in the second input patch, a first indication for each of the channels, the first indication distinguishably indicating whether the switching for each of the channels is enabled or disabled.

In the audio signal processing device constructed as described above, the display may be configured to display, on the setting screen in the second input patch, a mode indication that distinguishably indicates whether a currently selected mode is the first mode or the second mode.

In the audio signal processing device constructed as described above, the display may be configured to display, on the setting screen in the second input patch, a second indication for each of the channels, the second indication distinguishably indicating whether the audio signals supplied to each of the channels are output directly to a corresponding one of the output ports patched to each of the channels.

The audio signal processing device constructed as described above may further comprise a sub output patch configured such that, when the second input patch patches one input port to one channel, the sub output patch outputs audio signals received by the one channel to one output port that corresponds to the one input port, in conjunction with the patching of the one input port to the one channel.

What is claimed is:

1. An audio signal processing device, comprising:

a plurality of input ports configured to receive audio signals, the plurality of input ports including a first group of first input ports and a second group of second input ports, wherein all the first input ports of the first group are different from all the second input ports of the second group;

a plurality of channels configured to process audio signals;

a first input patch configured to patch the first input ports of the first group to respective channels of the plurality of channels as destination channels;

a second input patch configured to patch the second input ports of the second group to respective channels of said destination channels;

a display configured to display:

(i) a first setting screen in which a first patching indication indicates patching of one of the first input ports to its respective destination channel, the first setting screen showing the destination channels and the first input ports, and (ii) a second setting screen in which a second patching indication indicates patching of one of the second input ports to the respective destination channel, the second setting screen showing the destination channels and the second input ports, wherein all the input ports shown in the second setting screen are different from all the input ports shown in the first setting screen;

a patching-state setter configured to set, for each of the plurality of channels, a patching-state as one of (i) a first patching-state in which the respective first input port is patched to the respective destination channel, while the respective second input port is not patched to the respective destination channel, the first patching-state corresponding to the first patching indication that the display is configured to display in the first setting screen, and (ii) a second-patching state in which the respective second input port is patched to the respective destination channel, while the respective first input port is not patched to the respective destination channel, the second patching-state corresponding to the second patching indication that the display is configured to display in the second setting screen; and a mode selector configured to select one of a first mode and a second mode of the audio signal processing device, wherein the display is configured to further display on the second setting screen, for each of the destination channels, one of a first patching-state indication and a second patching-state indication, the first patching-state indication distinguishably indicating a patching-state of the respective destination channel is set to the first patching-state corresponding to the first patching indication that the display is configured to display in the first setting screen, the second patching-state indication distinguishably indicating the patching-state of the respective destination channel is set to the second patching-state corresponding to the second patching indication that the display is configured to display in the second setting screen, and wherein, (i) when the first mode is selected, the patching-states of all the destination channels are set to the first patching-state, and (ii) when the second mode is selected, the patching-state of each of the destination channels having the second patching-state indication displayed in the second setting screen is set to the second patching-state.

2. The audio signal processing device according to claim 1, wherein the display is configured to display the patching of input ports to channels in the second input patch on a grid in which input ports are displayed in one of a horizontal direction and a vertical direction while channels are displayed in the other of the horizontal direction and the vertical direction, and wherein, when a cell of the grid at which a respective channel and a respective input port intersect is operated, the second input patch patches the respective input port to the respective channel.

3. The audio signal processing device according to claim 2, wherein the display is configured to display, on the second setting screen in the second input patch, names of input ports in order in the horizontal direction, names of channels in order in the vertical direction, and names of a plurality of output ports in order in the horizontal direction, and wherein audio signals supplied to one or more of the channels, whose names are displayed in order in the horizontal direction, are output directly to the plurality of output ports.

4. The audio signal processing device according to claim 3, wherein the display is configured to display, on the second setting screen in the second input patch, a mode indication that distinguishably indicates whether a currently selected mode is the first mode or the second mode.

5. The audio signal processing device according to claim 3, wherein the display is configured to display, on the second setting screen in the second input patch, another indication for each of the destination channels, the another indication distinguishably indicating whether the audio signals supplied to the respective destination channel are output directly to a corresponding one of the output ports patched to the respective destination channel.

6. The audio signal processing device according to claim 1, further comprising a sub output patch configured such that, when the second input patch patches a respective one of the second input ports to a respective one of the channels, the sub output patch outputs audio signals received by the respective channel to a respective one of the output ports that corresponds to the respective second input port, in conjunction with the patching of the respective second input port to the respective channel.

7. An audio signal processing device, comprising:

a plurality of input ports configured to receive audio signals, the plurality of input ports including a first group of first input ports and a second group of second input ports, wherein all the first input ports of the first group are different from all the second input ports of the second group;

a plurality of channels configured to process audio signals;

a first input patch configured to patch the first input ports of the first group to respective channels of the plurality of channels as destination channels;

a second input patch configured to patch the second input ports of the second group to respective channels of said destination channels;

a display configured to display:

(i) a first setting screen in which a first patching indication indicates patching of one of the first input ports to its respective destination channel, the first setting screen showing the destination channels and the first input ports, and (ii) a second setting screen in which a second patching indication indicates patching of one of the second input ports to the respective destination channel, the second setting screen showing the destination channels and the second input ports, wherein all the input ports shown in the second setting screen are different from all the input ports shown in the first setting screen;

switching circuitry configured to set, for each of the plurality of channels, a patching-state as one of (i) a first patching-state in which the respective first input port is patched to the respective destination channel, while the respective second input port is not patched to the respective destination channel, the first patching-state corresponding to the first patching indication that the display is configured to display in the first setting screen, and (ii) a second-patching state in which the respective second input port is patched to the respective destination channel, while the respective first input port is not patched to the respective destination channel, the second patching-state corresponding to the second patching indication that the display is configured to display in the second setting screen; and controller circuitry configured to select one of a first mode and a second mode of the audio signal processing device, wherein the display is configured to further display on the second setting screen, for each of the destination channels, one of a first patching-state indication and a second patching-state indication, the first patching-state indication distinguishably indicating a patching-state of the respective destination channel is set to the first patching-state corresponding to the first patching indication that the display is configured to display in the first setting screen, the second patching-state indication distinguishably indicating the patching-state of the respective destination channel is set to the second patching-state corresponding to the second patching indication that the display is configured to display in the second setting screen, and wherein, (i) when the first mode is selected, the patching-states of all the destination channels are set to the first patching-state, and (ii) when the second mode is selected, the patching-state of each of the destination channels having the second patching-state indication displayed in the second setting screen is set to the second patching-state.

8. The audio signal processing device according to claim 7, wherein the display is configured to display the patching of input ports to channels in the second input patch on a grid in which input ports are displayed in one of a horizontal direction and a vertical direction while channels are displayed in the other of the horizontal direction and the vertical direction, and wherein, when a cell of the grid at which a respective channel and a respective input port intersect is operated, the second input patch patches the respective input port to the respective channel.

9. The audio signal processing device according to claim 8, wherein the display is configured to display, on the second setting screen in the second input patch, names of input ports in order in the horizontal direction, names of channels in order in the vertical direction, and names of a plurality of output ports in order in the horizontal direction, and wherein audio signals supplied to one or more of the channels, whose names are displayed in order in the horizontal direction, are output directly to the plurality of output ports.

10. The audio signal processing device according to claim 9, wherein the display is configured to display, on the second setting screen in the second input patch, a mode indication that distinguishably indicates whether a currently selected mode is the first mode or the second mode.

11. The audio signal processing device according to claim 9, wherein the display is configured to display, on the second setting screen in the second input patch, another indication for each of the destination channels, the another indication distinguishably indicating whether the audio signals supplied to the respective destination channel are output directly to a corresponding one of the output ports patched to the respective destination channel.

12. The audio signal processing device according to claim 7, further comprising a sub output patch configured such that, when the second input patch patches a respective one of the second input ports to a respective one of the channels, the sub output patch outputs audio signals received by the respective channel to a respective one of the output ports that corresponds to the respective second input port, in conjunction with the patching of the respective second input port to the respective channel.

* * * * *